US006731241B2

(12) United States Patent
Park et al.

(10) Patent No.: US 6,731,241 B2
(45) Date of Patent: May 4, 2004

(54) DUAL-POLARIZATION COMMON APERTURE ANTENNA WITH RECTANGULAR WAVE-GUIDE FED CENTERED LONGITUDINAL SLOT ARRAY AND MICRO-STRIPLINE FED AIR CAVITY BACK TRANSVERSE SERIES SLOT ARRAY

(75) Inventors: Pyong K. Park, Tucson, AZ (US); Sang H. Kim, Tucson, AZ (US); Joseph M. Anderson, Tucson, AZ (US); Jack H. Anderson, Medford, OR (US); Kevin P. Grabe, Tucson, AZ (US); David Y. Kim, Northridge, CA (US); Richard M. Oestreich, Tuscon, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 09/880,423

(22) Filed: Jun. 13, 2001

(65) Prior Publication Data

US 2004/0056814 A1 Mar. 25, 2004

(51) Int. Cl.[7] ..... H01Q 13/10; H01Q 21/06
(52) U.S. Cl. ..... 342/361; 343/771
(58) Field of Search ..... 343/771, 770; 342/361

(56) References Cited

U.S. PATENT DOCUMENTS 3,691,563 A * 9/1972 Shelton ..... 343/771
4,243,990 A * 1/1981 Nemit et al. ..... 343/770
4,716,415 A * 12/1987 Kelly ..... 343/771
4,967,167 A * 10/1990 Neifeld ..... 332/144
5,023,623 A * 6/1991 Kreinheder et al. ..... 343/725
5,619,216 A * 4/1997 Park ..... 333/137
5,831,583 A * 11/1998 Lagerstedt et al. ..... 343/770
6,166,701 A * 12/2000 Park et al. ..... 333/21 A

FOREIGN PATENT DOCUMENTS

WO WO 9953569 A1 * 10/1999 ..... H01Q/13/22

* cited by examiner

*Primary Examiner*—Gregory C. Issing
(74) *Attorney, Agent, or Firm*—Thomas J. Finn; Leonard A. Alkov; Glenn H. Lenzen, Jr.

(57) ABSTRACT

A dual-polarization common aperture antenna having fully populated common aperture dual polarized arrays. The inventive antenna includes a first and second arrays of radiating slots disposed in a faceplate. The second array is generally orthogonal and therefor cross-polarized relative to the first array. The first array is waveguide fed and the second array is stripline fed. In the illustrative implementation, the first array and the second array share a common aperture. The common aperture is fully populated and each array uses the aperture in its entirety. The first and second arrays of slots are arranged for four-way symmetry. Each slot in the first array is a vertically oriented, iris-excited shunt slot fed by a rectangular waveguide and centered on a broad wall thereof. The second array is a standing wave array in which each slot is an air cavity backed slot fed by an inverted micro-stripline offset from a center thereof.

31 Claims, 3 Drawing Sheets

30
68
66
34
68
66
11
30

DUAL-POLARIZATION COMMON APERTURE ANTENNA WITH RECTANGULAR WAVE-GUIDE FED CENTERED LONGITUDINAL SLOT ARRAY AND MICRO-STRIPLINE FED AIR CAVITY BACK TRANSVERSE SERIES SLOT ARRAY

BACKGROUND OF THE INVENTION

1. Field of the Invention

The present invention relates to antennas. More specifically, the present invention relates to radio frequency (radar) antennas for missile seekers and other applications.

2. Description of the Related Art

Radio frequency (RF) antennas are used in many communication, ranging and detection (radar) applications. In missile applications, the RF antenna is implemented as part of a missile seeker. The seeker comprises the antenna along with a transmitter and a receiver. Typically, missile seekers transmit and receive a beam having a single polarization. The polarization of a beam is the orientation of the electric field thereof. Hence, the polarization of a beam may be vertical, horizontal or circular.

Several dual polarization antennas are known in the art. One is a reflector antenna with dual polarization feed. This type of antenna is bulky, exhibits poor efficiency, and poor isolation between the two polarizations. This type of antenna is also very limited in its ability offer low sidelobe radiation performance. Furthermore, this type antenna can generally be used only for an electrically very large aperture (i.e. an aperture having a diameter larger than fifteen wavelengths).

A second approach involves the use of an array of dual polarized patches. This type of antenna offers low cost and low profile, but the bandwidth of each element is typically so narrow that it is very difficult to achieve high performance. The efficiency of this array is also typically poor due to dielectric losses and stripline conductor losses.

A third approach involves the use of a dual polarization rectangular waveguide array consisting of a stack-up of a rectangular waveguide-fed offset longitudinal slot array and a waveguide-fed tilted edge slot array. Unfortunately, this array exhibits poor performance because the offset slot excites an undesirable $TM_{01}$ odd mode in the parallel plate region formed by the tilted edge slot waveguides. The excited $TM_{01}$ odd mode causes high sidelobes and RF loss. A further performance limitation results from the coupling between apertures caused by the tilted edge slot containing a cross-polarization component.

A fourth approach involves the use of an arched notch dipole card array erected over a rectangular waveguide fed offset longitudinal slot array. In this approach, the arch is provided to improve the performance of the principal polarization slot array and minimize interactions between the two apertures. Unfortunately, the design of this type of array is very difficult because there is no easy or convenient method to account for the presence of the arched dipole array in the design of the slot array (every slot sees a different unit cell). The requirement to maximize the spacing between the face of the slot array and the arch cards to reduce interaction conflicts with the desired placement of the notch radiators on the quarter-wavelength above this surface for optimal image current formation. This limitation becomes especially severe at higher frequencies of operation.

Finally, a fifth approach involves the use of a common aperture for dual polarization array with a flat plate centered longitudinal shunt slot array and a stripline-fed notch-dipole array. This approach was disclosed and claimed in U.S. Pat. No. 6,166,701 issued Dec. 26, 2000 to Pyong K. Park et al.

and entitled DUAL POLARIZATION ANTENNA ARRAY WITH RADIATING SLOTS AND NOTCH DIPOLE ELEMENTS SHARING A COMMON APERTURE the teachings of which are incorporated herein by reference. This approach is very useful for very high frequency (Ka-band or higher) applications and electrically medium to large size arrays. For lower frequency applications such as X-band, and small diameter apertures, such as under seven wavelengths, the dipole card height is greater than a half-inch, which is often more than the available antenna depth. Therefore, it may not be practical to use this approach for lower frequency applications and electrically small to medium size antennas.

Accordingly, inasmuch as current trends in radar communication and antenna system design requirements emphasize the reduction of cost and volume while achieving high performance, a need exists in the art for an antenna design which offers an improved capability.

SUMMARY OF THE INVENTION

The need in the art is addressed by the dual-polarization common aperture antenna of the present invention. The inventive antenna includes first and second arrays of radiating slots disposed in a faceplate. The second array is generally orthogonal and therefor cross-polarized relative to the first array. The first array is waveguide fed and the second array is inverted micro-stripline fed.

In the illustrative implementation, the first array and the second array share a common aperture. The common aperture is fully populated and each array uses the aperture in its entirety. The first and second arrays of slots are arranged for four-way symmetry. Each slot in the first array is a horizontally oriented, iris-excited shunt slot fed by a rectangular waveguide and centered on a broad wall thereof. The second array is a standing wave array in which each slot is an air cavity backed slot fed by an inverted micro-stripline offset from a center thereof.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of considerable utility.

Significant system performance advantages can be achieved in radar and communication systems by use of dual polarized antennas. The current invention provides such an antenna.

Figure 1:
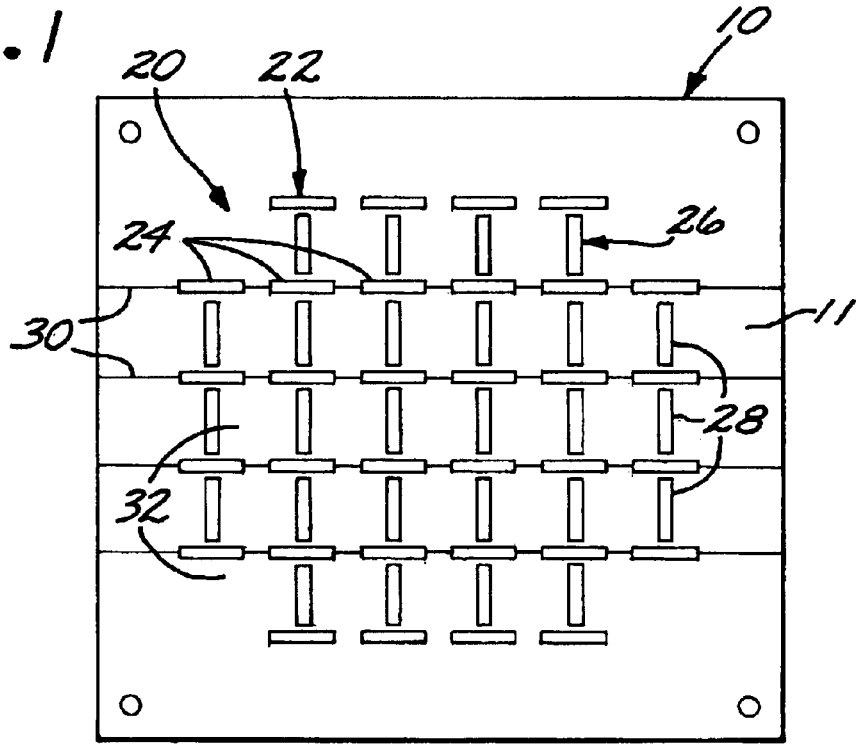
FIG. 1 is a front view of the dual-polarization common aperture antenna of the present invention.

FIG. 1 is a front view of the dual-polarization common aperture antenna of the present invention. As is common in the art, the antenna is constructed of a unitary block of aluminum or other suitable material. The antenna 10 has a faceplate 11 and a backplate 13 (not shown in FIG. 1). The antenna 10 has a common aperture 20 fully populated with elements for both polarizations and provides high gain and low sidelobe performance for both polarizations. Within the aperture 20 a first array 22 of horizontally oriented radiating slots 24 and an orthogonally polarized second array 26 of vertically oriented radiating slots 28 are provided. The first slots 24 are disposed in channels or recesses 30 in the faceplate 11 of the antenna. The slots and the recesses are machined into the antenna using techniques well known in the art. The waveguide slot channels 30 contribute a simple means to maintain a thin wall in the vicinity of the radiating slots, while simultaneously providing a thick broad wall 34 with which to totally accommodate the array two packaging needs. In the illustrative embodiment, the horizontal slots 24 are spaced 0.7 wavelength (0.7λ) apart with respect to the desired operating frequency of the antenna. Similarly, as discussed more fully below, the vertical slots 28 are spaced at 0.7λ.

Figure 2:
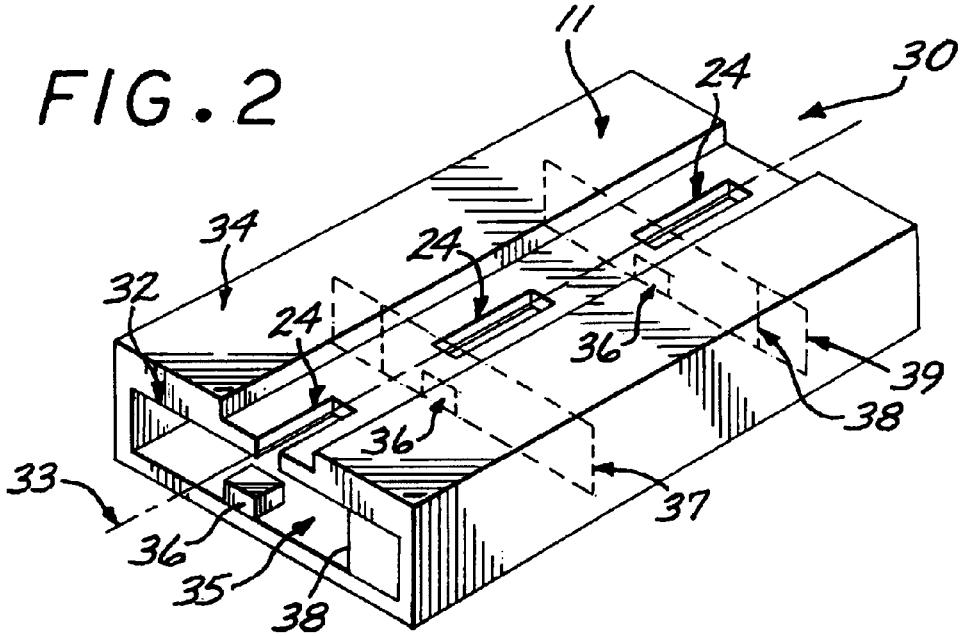
FIG. 2 is a diagram of a single channel of the inventive antenna showing the horizontal slots therein.

FIG. 2 is a diagram of a single channel of the inventive antenna showing the horizontal slots 24 therein. As illustrated in FIG. 2, each of the horizontal slots 24 in the first (main) array 22 is an iris-excited longitudinal shunt slot fed by a rectangular waveguide 32. The waveguide 32 is collinear with the horizontal slots 24 along a transverse axis 33 of the antenna 10. The slots 24 are centered on the broad walls 34 of the waveguides 32 to provide room for the second (cross-polarization) array 26. Each iris 35 consists of a capacitive element 36 and an inductive element 38. As is common in the art, the capacitive element 36 consists of a small sheet of conductive material disposed within the waveguide 32 transverse to the longitudinal axis thereof and below an associated slot 24. The inductive element 38 is a small sheet of conductive material mounted within the waveguide 32 transverse to the longitudinal axis thereof and below the associated slot 24. The combination of a capacitive element and an inductive element provides a 'ridge'0 iris 35 such as that disclosed and claimed in U.S. Pat. No. 6,201,507 issued Mar. 13, 2001 to Pyong K. Park et al. and entitled CENTERED LONGITUDINAL SHUNT SLOT FED BY A RESONANT OFFSET RIDGE IRIS the teachings of which are incorporated herein by reference. Note that the position of the inductive element is moved from one side of the iris to the other with each successive iris 37, 39, etc. so that the slots 35, 37 and 39 excite in-phase.

Figure 3:
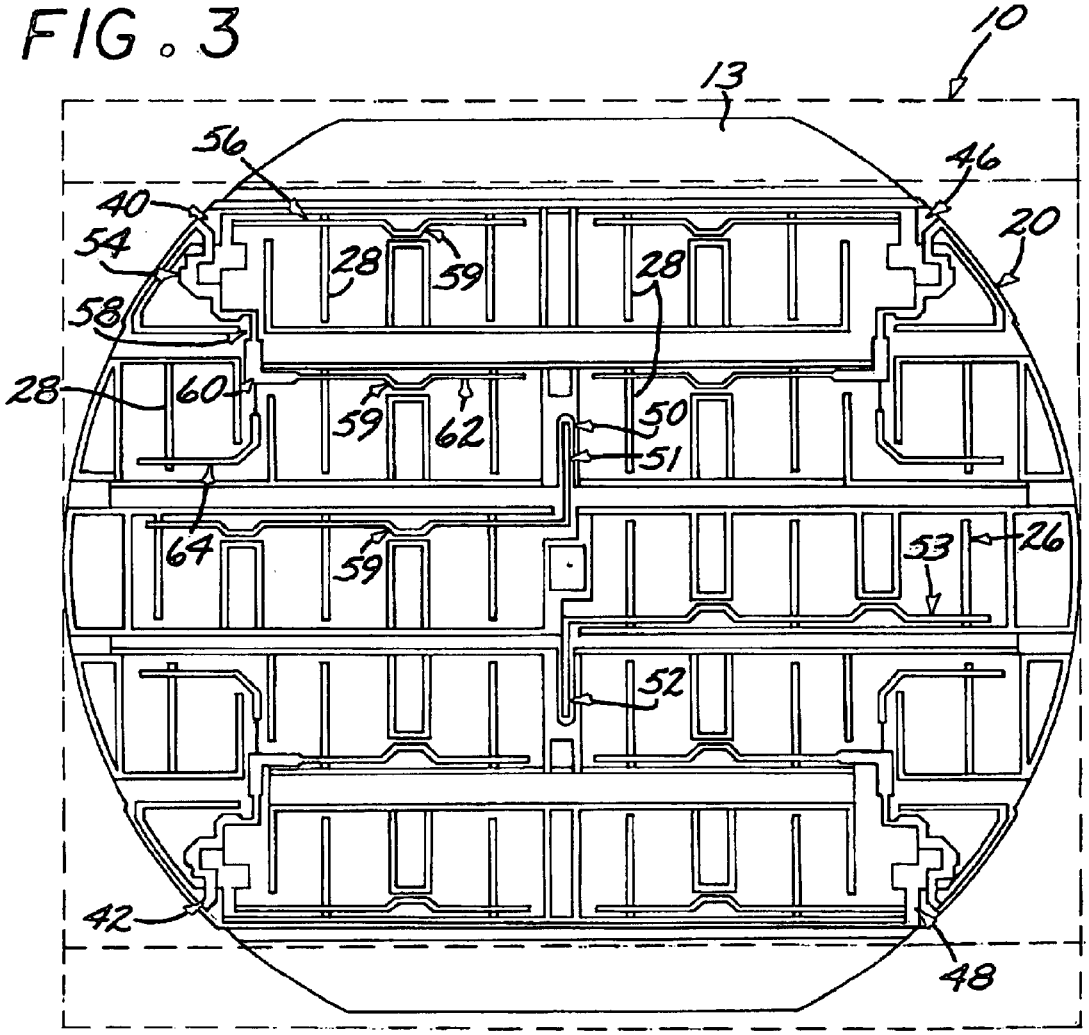
FIG. 3 is a sectional rear view of the dual-polarization common aperture antenna of the present invention showing the backplate thereof.

FIG. 3 is a sectional rear view of the dual-polarization common aperture antenna of the present invention showing the backplate 13 thereof with the ground plane removed. As shown in FIG. 3, the cross-polarization array 26 is realized with an efficient standing wave array of inverted micro-stripline-fed air-cavity backed slots 28. Each slot 28 is fed by one of six input ports 40, 42, 46, 48, 50 or 52. The first four ports 40, 42, 46, and 48, respectively, are located at corners of the aperture 20 while the fifth and sixth ports 50 and 52, respectively, are provided above and below the centerline of the aperture 20. Each of the first four ports 40, 42, 46, and 48 feeds an associated micro-strip power divider 54. The power divider 54 has a first output line 56 and a second output line 58. The first output line 56 feeds two vertical slots 28. Note the provision of a perturbation 59 in the line to adjust the line length thereof. The second output line 58 of each of the first four ports feeds a second power divider 60. The second power divider 60 has two output lines 62 and 64. The first line of the second power divider feeds two vertical slots 28 while the second line 64 feeds a single slot 28. The ports 50 and 52 feed lines 51 and 53, respectively, each of which, in turn, feed three vertical slots 28. In the preferred embodiment, the lines 51, 53, 56, 58, 62 and 64 are inverted micro-striplines.

Figure 4:
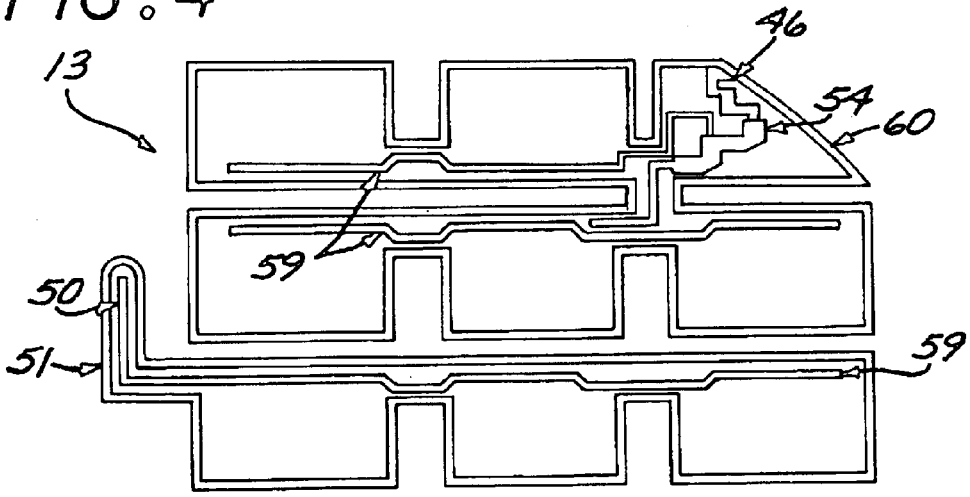
FIG. 4 is a magnified view of a section of the backplate of the inventive antenna showing the inverted micro-striplines thereon.

FIG. 4 is a magnified view of a section of the second array 26 of the inventive antenna showing the inverted micro-stripline traces thereon. As is well known in the art, micro-striplines are striplines in which the signal return energy is constrained to flow in a single ground plane. Inverted micro-striplines are micro-striplines which are enclosed within conductive channels in which the energy flows in the ground plane above the surface of the trace as well as to the ground plane on the surface of the backplate 13 (not shown). The micro-striplines are bonded to the surface of the faceplate 11 in a conventional manner. Those skilled in the art will appreciate that the invention is not limited to the use of inverted micro-striplines to feed the vertical slots 28. Other arrangements may be used without departing from the scope of the present teachings.

Figure 5:
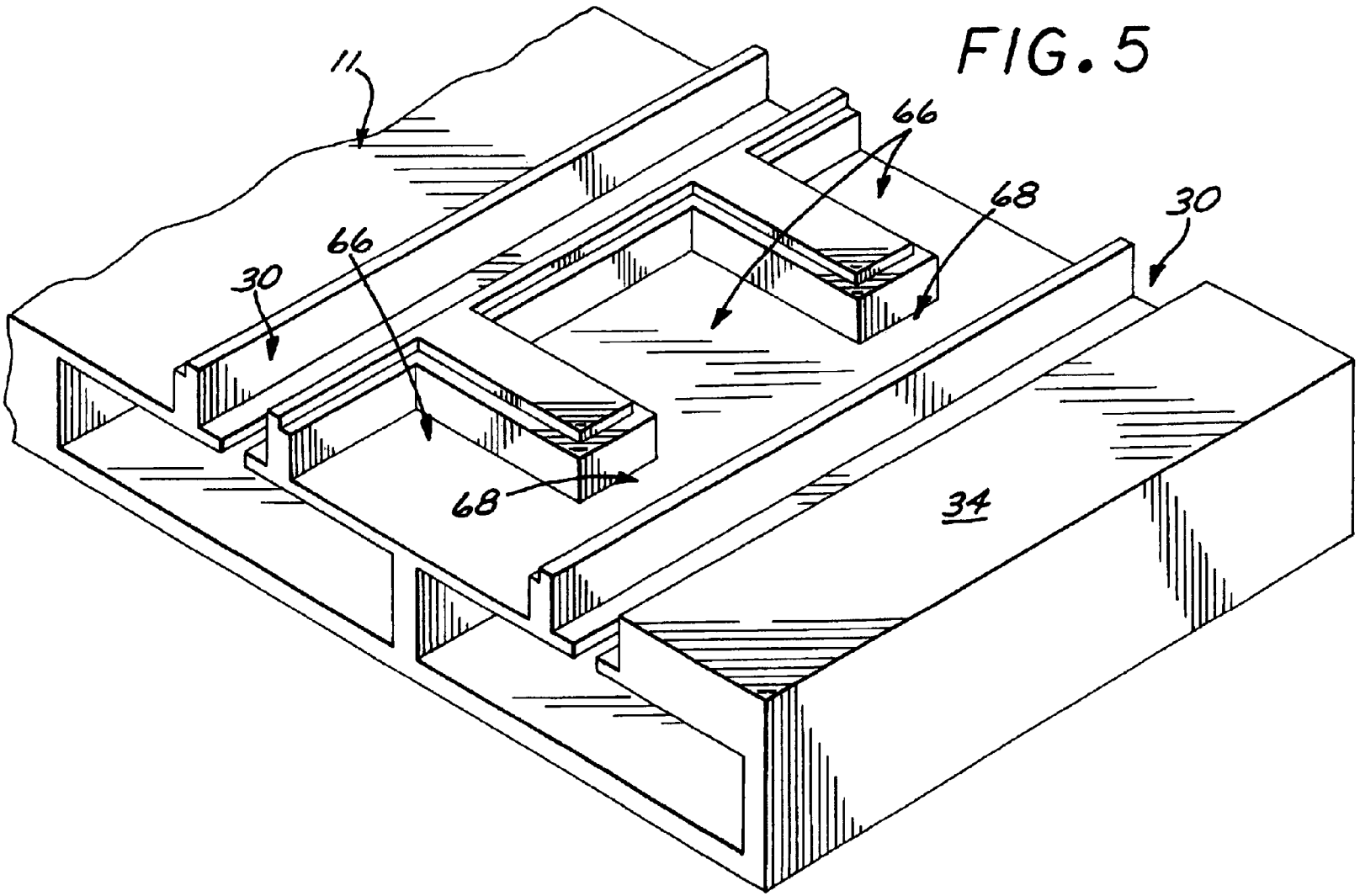
FIG. 5 is a perspective sectional view showing two channels in the inventive antenna.

FIG. 5 is a perspective sectional view showing two channels 30 in the inventive antenna. As shown in FIGS. 1 and 5, the channels 30 are machined into the front of the thick wall of the first array 22 below each of the vertical slots 24. The cavities 66 and channels 68 are machined into the thick wall 34 of the faceplate 11 to provide room for the air cavity-backed slots 28 and their associated interconnecting micro-stripline transmission lines. The cavities 66 and channels 68 contain provisions for mounting and locating the printed circuit boards in a manner which places the radiating slot ground plane at the same position as the top of the channels 30 associated with the main array slots 24, thus minimizing discontinuities in the ground plane and preserving full performance of the main array 22. The cross-polarization radiating slots 28 are supported above the cavities 66 and are symmetrically located between the main array slots 24. The interconnecting micro-stripline transmission lines which feed the array 26 feed network are isolated from one another in channels 68 to eliminate the undesired effect of cross talk or radiation. The radiation of each cross-polarization (vertical) slot 28 is controlled by offset of the micro-stripline feed line from the center of the slot 28. In accordance with the present teachings, the air cavities 66 and the channels 68 are provided to improve the RF bandwidth of the radiating slots 28.

In order to orthogonally align the main (horizontal) array slots 24 and the cross-polarization (vertical) array slots 28, the slot spacing for cross-polarization array 26 must be the same as the principal polarization array 22 spacing, which is about 0.7λ. Furthermore, the cross-polarization slot spacing in the micro-strip medium has to be one wavelength apart to form a collimated radiation pattern. The micro-stripline offers a proper propagation constant such that 0.7λ in free space is equivalent to 0.9λ in micro-stripline. By introducing small perturbations 59 in the micro-striplines, as shown in FIGS. 3 and 4, an additional 0.1λ line length increase is readily achieved, thus providing the necessary one wavelength inter-element spacing.

The slot arrangement for both arrays exhibits four-way symmetry, which provides good isolation between the two orthogonally polarized arrays. Optimal electrical isolation between the two arrays is achieved as a result of the mutually orthogonal slot geometries.

Both arrays 22 and 26 of the antenna 10 utilize the entire aperture 20 to maximize performance. The inventive antenna realizes both arrays in efficient standing wave array configurations to concurrently achieve high gain and low sidelobe levels. A particularly novel feature of this invention is the concurrent realization of a high-performance dual polarization common aperture antenna array within a small cross sectional profile. This is achieved by using rectangular wave-guide-fed centered longitudinal shunt slots in conjunction with inverted micro-stripline-fed air-cavity-backed slots within the same design geometry.

This inventive antenna design offers the following advantages relative to other approaches:

1. It offers high RF performance for both arrays (low sidelobes, low RF loss, exceptional isolation between the two arrays).

2. It is highly efficient for both arrays as they are standing wave fed.

3. It has a very low profile due to the horizontal layer structure (low profile) antenna. The low profile configuration is highly desirable because the maximum size aperture can be realized. This invention provides optimum gimbal/radome envelope and increased functionality and improved performance within the existing volume without significant cost impact.

4. Its functionally independent layered structures more easily adapt to manufacturing processes.

5. This approach is easy to design because it possesses a well defined unit cell for both arrays.

6. It offers exceptionally good isolation between the two arrays (−50 dB) due to its orthogonal geometries.

7. The inventive approach is applicable up through Ku band.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. A dual-polarization common aperture antenna comprising:

a first array of radiating slots disposed in a faceplate;

a waveguide for feeding electromagnetic energy to said first array of radiating slots;

a second array of radiating slots disposed in said faceplate, said second array being orthogonal to said first array of radiating slots; and a micro-stripline for feeding said second array of radiating slots.

2. The invention of claim 1 wherein each slot in said first array of radiating slots is horizontally oriented.

3. The invention of claim 2 wherein each of said slots in said first array of slots is a shunt slot.

4. The invention of claim 3 wherein each slot in said first array of slots is iris-excited.

5. The invention of claim 4 wherein each shot is excited by a ridge iris.

6. The invention of claim 1 wherein said waveguide is rectangular.

7. The invention of claim 6 wherein said first array of radiating slots is centered on broad walls of said rectangular waveguide.

8. The invention of claim 1 wherein said second array of slots radiates cross-polarized relative to said first array of slots.

9. The invention of claim 1 wherein said second array of slots is a standing wave array.

10. The invention of claim 1 wherein said micro-stripline is offset from a center of at least one of said radiating slots in said second array of slots.

11. The invention of claim 1 wherein said micro-stripline has a perturbation therein to increase the length thereof.

12. The invention of claim 11 wherein said slots in said second array are spaced one wavelength apart with respect to said electromagnetic energy.

13. The invention of claim 1 wherein each slot in said second array of slots is an air cavity backed slot.

14. The invention of claim 1 wherein said first array of slots and said second array of slots are arranged for four-way symmetry.

15. The invention of claim 1 wherein the radiating slots in the second array of slots are spaced in proportion to a spacing between the slots in the first array of slots.

16. The invention of claim 15 wherein said spacing is approximately equal to 0.7 times the wavelength of said electromagnetic energy.

17. A dual-polarization common aperture antenna comprising:

a first array of horizontally oriented radiating slots disposed in a faceplate;

a waveguide for feeding electromagnetic energy to said first array of radiating slots;

a second array of radiating slots disposed in said faceplate, each slot in said second array being orthogonal to said slots in said first array whereby said second array is cross-polarized relative to said first array; and a micro-stripline for feeding said second array of radiating slots, whereby said first array and said second array share a common aperture.

18. The invention of claim 17 wherein each of said slots in said first array of slots is a shunt slot.

19. The invention of claim 18 wherein each slot in said first array of slots is iris-excited.

20. The invention of claim 19 wherein each shot is excited by a ridge iris.

21. The invention of claim 17 wherein said waveguide is rectangular.

22. The invention of claim 21 wherein said first array of radiating slots is centered on broad walls of said rectangular waveguide.

23. The invention of claim 17 wherein said second array of slots is a standing wave array.

24. The invention of claim 17 wherein said micro-stripline is offset from a center of at least one of said radiating slots in said second array of slots.

25. The invention of claim 17 wherein said micro-stripline has a perturbation therein to increase the length thereof.

26. The invention of claim 25 wherein said slots in said second array are spaced one wavelength apart with respect to said electromagnetic energy.

27. The invention of claim 17 wherein each slot in said second array of slots is an air cavity backed slot.

28. The invention of claim 17 wherein the first array of slots and said second array of slots are arranged for four-way symmetry.

29. The invention of claim 17 wherein the radiating slots in the second array of slots are spaced in proportion to a spacing between the slots in the first array of slots.

30. The invention of claim 29 wherein said spacing is approximately equal to 0.7 times the wavelength of said electromagnetic energy.

31. A method for feeding a dual-polarization common aperture antenna including the steps:

feeding electromagnetic energy to a first array of radiating slots in a faceplate of said antenna with a waveguide and feeding a second array of radiating slots disposed in said faceplate with a stripline, said second array being cross-polarized relative to said first array.

* * * * *